United States Patent [19]

Arima et al.

[11] Patent Number: 4,749,171

[45] Date of Patent: Jun. 7, 1988

[54] METHOD AND APPARATUS FOR MEASURING SLAG-FOAM CONDITIONS WITHIN A CONVERTER

[75] Inventors: Keizi Arima; Yujiro Ueda; Toru Yoshida, all of Sakai, Japan

[73] Assignee: Nippon Steel Corporation, Tokyo, Japan

[21] Appl. No.: 63,698

[22] Filed: Jun. 12, 1987

Related U.S. Application Data

[63] Continuation of Ser. No. 647,691, Sep. 6, 1984, abandoned.

[51] Int. Cl.[4] ..... C21B 7/24

[52] U.S. Cl. ..... 266/44; 266/100

[58] Field of Search ..... 266/80, 90, 99, 100, 266/94, 225, 78, 81, 44; 75/45, 59.1

[56] References Cited

U.S. PATENT DOCUMENTS

| | | | |
|---|---|---|---|
| 2,113,450 | 4/1938 | Lasky et al. | 266/100 |
| 2,182,064 | 12/1939 | Vogt | 266/100 |
| 2,621,808 | 12/1952 | Blakeney | 266/94 |
| 3,591,296 | 7/1971 | Kunioka et al. | 266/99 |

FOREIGN PATENT DOCUMENTS

| | | |
|---|---|---|
| 52-101618 | 8/1977 | Japan . |
| 54-33790 | 3/1979 | Japan . |
| 54-114414 | 9/1979 | Japan . |
| 55-104417 | 8/1980 | Japan . |
| 57-140812 | 8/1982 | Japan . |
| 58-48615 | 3/1983 | Japan . |

*Primary Examiner*—L. Dewayne Rutledge
*Assistant Examiner*—S. Kastler
*Attorney, Agent, or Firm*—Kenyon & Kenyon

[57] ABSTRACT

A method and apparatus for directly observing the slag-foaming conditions in a vessel interior.

A device for observing the vessel interior light is disposed in a throughhole extending through the side wall of a top-blowing or top- and bottom-blowing converter to reach the vessel interior. The converter operation can be carried out at a high accuracy on the basis of this observation.

4 Claims, 5 Drawing Sheets

METHOD AND APPARATUS FOR MEASURING SLAG-FOAM CONDITIONS WITHIN A CONVERTER

This application is a continuation, of application Ser. No. 647,691, filed Sept. 6, 1984, now abandoned.

BACKGROUND OF THE INVENTION (1) Field of the Invention

The present invention relates to a method and apparatus for directly observing slag-foaming conditions within a converter used for steel refining.

(2) Description of the Prior Art

In refining molten pig iron and steel in a converter, pure oxygen is ejected from a lance inserted through the mouth of the converter into the converter body (below "vessel"). The oxygen is blown onto the molten steel to both effect decarburization and stir the molten steel. In addition, flux is charged into the converter to form molten slag, thereby effecting dephosphorization, desulfurization, or the like due to the reactions between the molten slag and steel.

Slag foaming occurs due to several slag conditions, such as the slags composition, viscosity, the total amount of oxygen in the slag, etc. Too extensive slag foaming causes the slag and even molten steel to overflow the converter mouth, which overflow is referred to as "slopping". Of course, the composition of the molten steel and the steel yield are greatly influenced by slopping. Also, various problems are caused, such as reduction in the operational efficiency and in the calorific content of the recovered gases, impairment of the operational environment, e.g., generation of brown smoke, and damage to the steelmaking devices. Slopping therefore must be suppressed as much as possible.

Various proposals have been made on how to enable prompt prediction of the slag conditions within a converter and hence realize optional converter operation without slopping.

Japanese Unexamined Patent Publication (Kokai) No. 52-101618 discloses a method for estimating the amount of slag by calculating the oxygen balance based on information on the waste gases during blowing and then estimating the amount of oxides formed in the converter, i.e., the molten slag. In this method, however, there is an unavoidable time delay due to the gas analysis and mathematical analysis. In addition, since slopping is not dependent upon just the amount of molten slag alone, the accuracy of prediction of slopping is not very high.

Various attempts have also been made on detecting the slag level by physical means. These include an acoustic measuring method (Japanese Unexamined Patent Publication No. 54-33790), a vibration measuring method (Japanese Unexamined Patent Publication No. 54-114,414), a method for measuring the inner pressure of a converter (Japanese Unexamined Patent Publication No. 55-104,417), a method using a microwave gauge (Japanese Unexamined Patent Publication No. 57-140812), and a method for measuring the surface temperature of the converter body (Japanese Unexamined Patent Publication No. 58-48615).

In the acoustic measuring method, changes in the frequency and magnitude of the acoustics generated in the converter are monitored to estimate the slag level and to predict slopping.

In the vibration measuring method, changes in the magnitude of lance vibration and the wave transition of the lance vibration are monitored during blowing to estimate the slag level or conditions and then to predict slopping.

In the method for measuring the inner pressure of a converter, variations in the ejecting pressure of the waste gases through the converter mouth are monitored to predict slopping.

In the method using a microwave gauge, a microwave is directly projected into the converter interior to directly measure the slag level based on the FM radar technique and to predict slopping.

In the method for measuring the surface temperature of a converter body, the energy emission from the upper and lower parts of the converter body in detected as temperature, and the occurrence and magnitude of slopping are predicted based on the temperature magnitude and peak values.

The acoustic measuring method, vibration measuring method, method for measuring the inner pressure of a converter, and method for measuring the surface temperature of the converter body are all indirect measuring methods and suffer from low accuracies of prediction of slopping due to the inability to quantitatively measure the slag level or conditions. The method using a microwave gauge enables direct measurement of the slag level, but suffer from the fact that it is not easy to detect or estimate abnormalities by microwave measurement, since the melt, slag, gases, and the like effect considerably complicated movement in the converter during blowing. In addition, this method requires sophisticated signal processing, which increases the cost of the measuring device.

SUMMARY OF THE INVENTION

The present inventors recognized, as a result of various studies concerning abnormal reactions in a converter, that the occurrence of such abnormal reactions is closely related to the slag-foaming conditions, i.e., the foaming behavior of slag. The present inventors studied the foaming behavior of slag and discovered that the light intensity of the gaseous atmosphere and the wavelength characteristics of light emitted from the gaseous atmosphere considerably differ from those of the slag. The present inventors discovered that they could positively utilize such differences to detect the foaming behavior.

The present invention provides a method and apparatus for directly observing slag-foaming conditions, i.e., the slag-foaming conditions, in a converter during blowing, thereby allowing more precise and speedy observation than in the prior art and contributing to a highly accurate converter operation.

The method according to the present invention is characterized in that at least one observation device of the vessel-interior light is disposed in at least one throughhole of the side wall of a converter so as to face the vessel interior and observe the slag-foaming conditions.

The apparatus according to the present invention comprises a light-detecting device including a receptor, which receptor is disposed in a throughhole of the side wall of a converter so as to face the vessel interior, and a device for detecting the intensity and/or wavelength of a light signal input from the light-detecting device.

DESCRIPTION OF THE PREFERRED EMBODIMENTS

Figure 1:
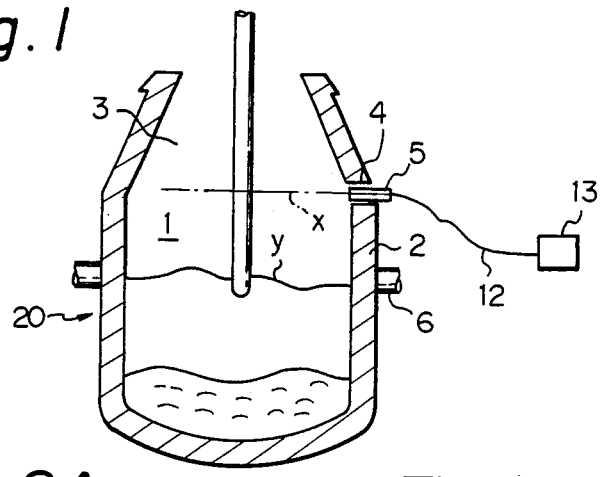
FIG. 1 is a cross-sectional view of a top-blowing converter, schematically showing an embodiment of mounting a device for observing the vessel-interior light on the converter.

FIG. 1 is a cross-sectional view of a top-blowing converter, schematically showing an embodiment of mounting a device for observing the vessel-interior light. Referring to FIG. 1, a converter 1 is provided, on its side wall 2, with at least one throughhole 4 opening into the vessel interior 3. At least one vessel-interior observation device 5 is disposed in the throughhole 4 to face the vessel interior 3 and observe the intensity or the wavelength of the light emitted from the slag and gaseous atmosphere within the converter 1. This observation device 5 may be a photometer and is hereinafter referred to as the photometer 5. In FIG. 1, only one throughhole and observation device are shown.

It is possible, based on the measurement of intensity and/or wavelength of the light, to monitor whether slag-foaming occurs above or beneath a processing level X of the photometer 5.

Figure 2A:
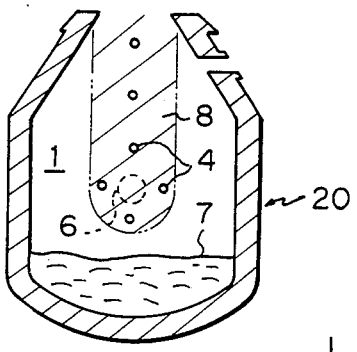
FIGS. 2A through 2C are cross-sectional views of a converter, showing non-immersion portions of the converter side wall.
Figure 2B:
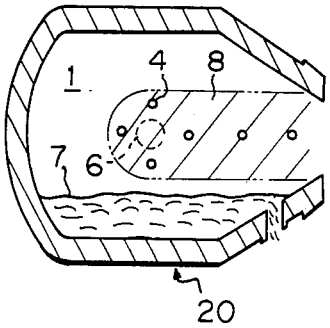
Figure 2C:
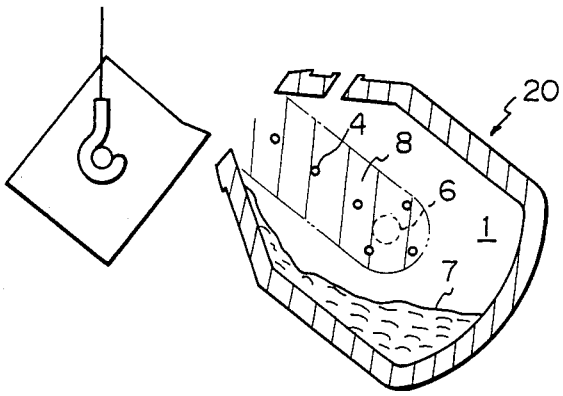

FIGS. 2A to 2C show non-immersion portions 8 of the converter side wall 20, i.e., in the converter upright position, tilting position for tapping, and tilting position for charging the pig iron from the ladle, respectively. In each of the positions shown in FIGS. 2A, 2B, and 2C, the portion of the converter wall 20 where a trunnion shaft 6 is rigidly secured and the region around that portion are not immersed within a melt 7. This portion and region, shown by the hatching are the non-immersion portion 8. The throughholes 4 can be formed through the non-immersion portion 8 to prevent the melt 7 from entering the throughholes 4.

As is described below, the photometers 5 can also be removably inserted into the tapping hole. When the molten steel is tapped through the tapping holes, the photometers 5 are removed therefrom.

Figure 3A:
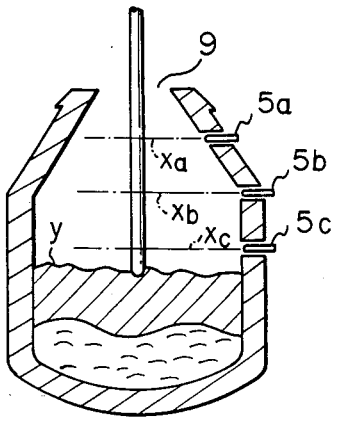
FIGS. 3A through 3C, FIG. 4, and FIG. 5 illustrate the principle of the present invention, FIGS. 3A through 3C showing the position of mounting the devices for observing vessel-interior light and FIGS. 4 and 5 showing time charts on the level of detected light signals.
Figure 3B:
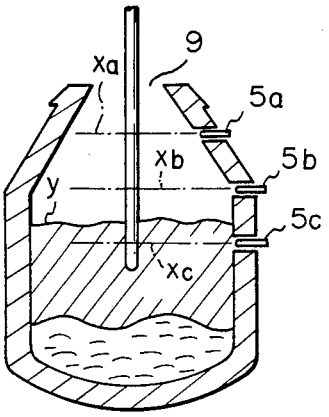
Figure 3C:
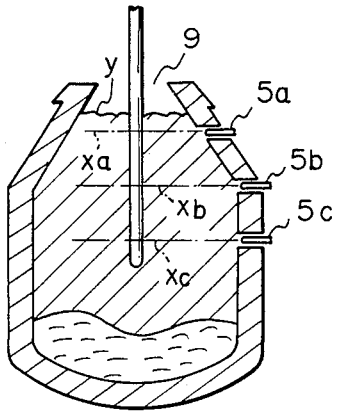
Figure 4:
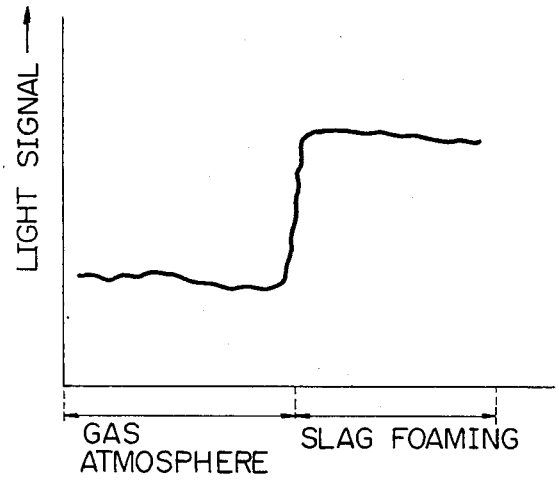
Figure 5:
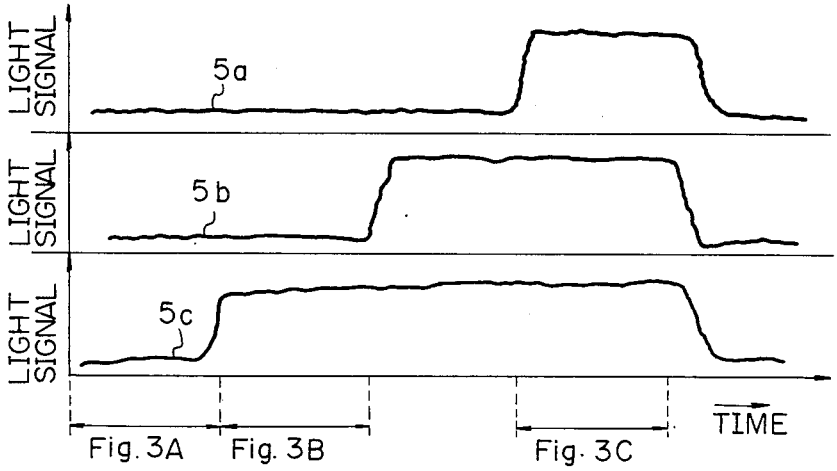

FIGS. 3A through 3C, FIG. 4, and FIG. 5 illustrate the principle of the present invention, FIGS. 3A through 3C showing the portions of mounting the devices for observing vessel-interior light and FIGS. 4 and 5 showing time charts on the level of detected light signals. Referring to FIGS. 3A through 3C, three photometers 5*a*, 5*b*, and 5*c* are arranged as seen in the vertical direction of the converter, so as to measure the vessel-interior light at the levels Xa, Xb, and Xc, respectively. The position of the throughholes 4, i.e., their distance from the bottom or mouth of the converter 1, must be empirically determined by the size and capacity of the converter 1. In the case of a single throughhole 4 the throughhole 4 must be located at the highest target slag level. In the case of plurality of throughholes 4, the highest and lowest throughholes 4 must be located straddling the highest target slag level.

FIG. 4 shows the light signal (ordinate) detected by any one of the photometers 5*a*, 5*b*, and 5*c* and then subjected to signal processing with the aid of an appropriate filter. The abscissa of FIG. 4 indicates the blowing time periods, the former period when the gaseous atmosphere is present till beneath the level Xa, Xb, or Xc and the latter being when foaming slag is present beneath the levels Xa, Xb, or Xc.

FIG. 5 illustrates the results of continuous measurement of the vessel-interior light by the photometers 5*a* through 5*c*. Under the slag-foaming conditions shown in FIG. 3A, all of the photometers 5*a* through 5*c* face or are exposed to the gaseous atmosphere, which indicates that the slag-foaming level y is located beneath the level Xc.

Under the slag-foaming conditions shown in FIG. 3B, the photometers 5*a* and 5*b* face or are exposed to the gaseous atmosphere and the photometer 5*c* faces or is exposed to the foaming slag. The slag-foaming level y is therefore located beneath the level of the converter mouth 9 and between the levels Xb and Xc.

Under the slag-foaming conditions shown in FIG. 3C, all of the photometers 5*a* through 5*c* face or are exposed to the slag. The slag-foaming level y is therefore located between the level of the converter mouth 9 and the level Xa of the photometer 5a.

The complicated foaming behavior of slag can therefore be accurately monitored by means of mounting a plurality of the photometers in the vertical direction and continuously measuring the vessel-interior light during the operation of the converter 1. If necessary, photometers may also be mounted along the width of the converter 1.

As described above, the intensity of light of the gaseous atmosphere and the wavelength characteristics of light emitted from the gaseous atmosphere considerably differ from those of the slag. Therefore, by direct observation of the vessel-interior light, it is possible to distinguish, without signal processing of the light, the light upon facing or exposure to the slag from the light upon facing or exposure to the gaseous atmosphere. However, if the vessel-interior light is subjected to signal processing with regard to the intensity or wavelength of the light, a clearer image of the slagforming conditions can be obtained. Also as is described in detail hereinbelow, the obtained signals can be advantageously utilized for controlling various blowing operations.

Using the slag-foaming behavior, one can preliminarily determine slag-forming criteria specifying the relationship between such behavior and slag-forming conditions. Therefore, according to an embodiment of the present invention, it is possible to compare the detected intensity and/or wavelength of the vessel-interior light with the slag-forming criteria determined for specific slag-forming conditions. The slag-forming criteria are determined for each converter having a specified structure and vessel volume and for each blowing condition.

The value detected by the photometers 5a through 5c (FIGS. 3A through 3C) is compared with the slag-forming criteria, thereby achieving detection of slag-forming conditions.

An example of the slag-forming criteria is as follows. When the slag-forming level y arrives at the level Xa of the highest photometer 5a, this means there is excessive slag formation and a high possibility of slopping. The level Xa can therefore be established as the slag-forming criterion indicating excessive formation of slag.

The slag-forming criteria are determined for each type of slag formation. That is, dephosphorization requires formation of a dephosphorizing slag having an appropriate total amount of iron oxide(s) for a normal dephosphorization reaction and also having a sufficient volume. The formation of the dephosphorizing slag can be verified by monitoring the slag-forming level y, e.g., at the lowest level Xc of the photometer 5c. If the level of slag is beneath the lowest level Xc during the dephosphorizing period, abnormality in slag formation occurs.

Although the above explanation was made with reference to a plurality of photometers 5a through 5c arranged in the converter 1, it is possible to satisfactorily observe the slag-forming conditions even by a single photometer, as shown in FIG. 1 and as described hereinbelow.

Figure 6:
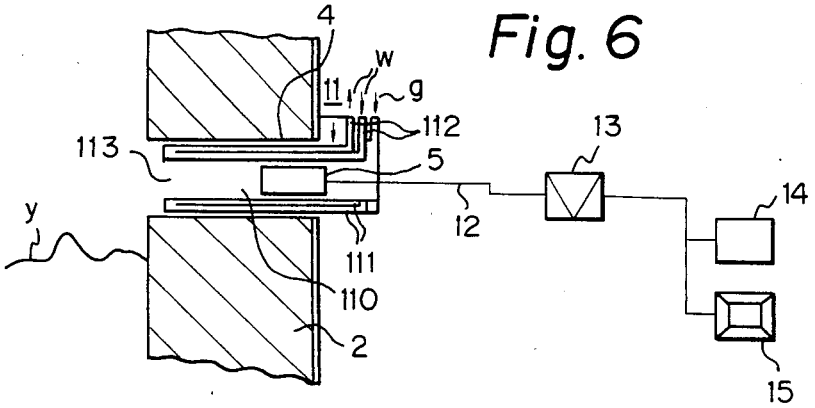
FIGS. 6 and 7 are partial cross-sectional views of a converter, showing different mounting structures of a device for observing the vessel-interior light.
Figure 7:
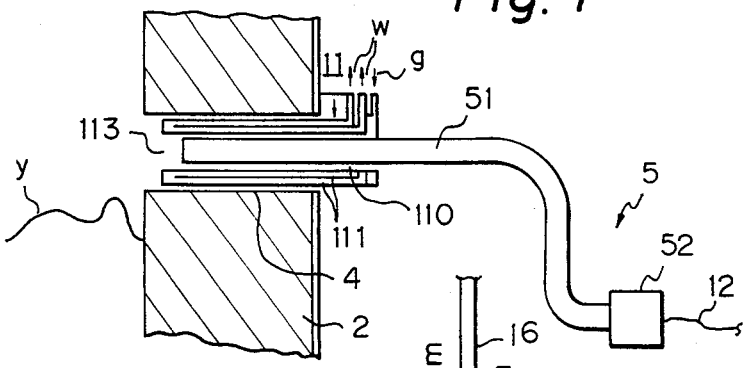

FIGS. 6 and 7 are partial cross-sectional views of a converter, showing different mounting structures of a photometer. Referring to FIG. 6, a photometer 5 is mounted in the throughhole 4 via a protective tube 11 having an inner cylinder 110. A cooling-water circulating channel 111 is formed in the protective tube 11. Cooling water w is supplied into the cooling-water circulating channel 111 via one of conduits 112. The water w is withdrawn via the other conduit 112. The photometer 5 is installed within the inner cylinder 110 in such a manner that its active side faces the vessel interior. Purge gas, such as $N_2$, Ar, $CO_2$, or another inert gas g, is supplied to and passed through the inner cylinder 110 and then ejected through the aperture 113 into the vessel. During its passage and ejection, the purge gas cools the photometer 5 and prevents gases including dust, slag, or the like from entering the inner cylinder 110.

The signal detected by the photometer 5 is input via a cable 12 into a signal processing device 13, such as a transmission filter, a computing device 14, and a display device 15.

The converter operation may be controlled either automatically or by a human operator. In automatic control, the signal detected by the photometer 5 is compared with the slag-forming criteria preliminarily input into the computing device 14 so as to automatically detect the slag-forming conditions. A warning signal or operating command is thereupon generated from the computing device 14 to various controlling devices (not shown). In control by a human operator, the operator watches detected values indicated on the display device 15 and compares them with predetermined slag-forming criteria, to control the converter operation.

FIG. 7 shows another examples of the photometer in FIG. 7, the same reference numerals and symbols as those of FIG. 6 indicate identical members. An optical conductor 51, i.e., a body capable of transmitting at a low loss the light emitted from a high temperature body, e.g., a quartz-based optical fiber, is located in the inner cylinder 110 of the protective tube 11. The optical conductor 51 is connected to the body of a photometer 52, which is disposed at an appropriate position outside the converter. The structure shown in FIG. 7 is particularly advantageous, since the body of photometer 52, which is expensive, can be located a safe distance from the high-temperature wall 2.

The photometer 5 is not limited to any particular form provided that it can measure the intensity and/or wavelength of the vessel-interior light. The photometer 5 includes various assemblies; a MOS or CCD device assembled with an optical filter, and a lens; a spectrometer and a photomultiplier; and an optical thermometer and a detector of the temperature profile.

The present invention will be further clarified by the ensuing examples, which, however, by no means limit the invention.

EXAMPLE 1

Figure 8:
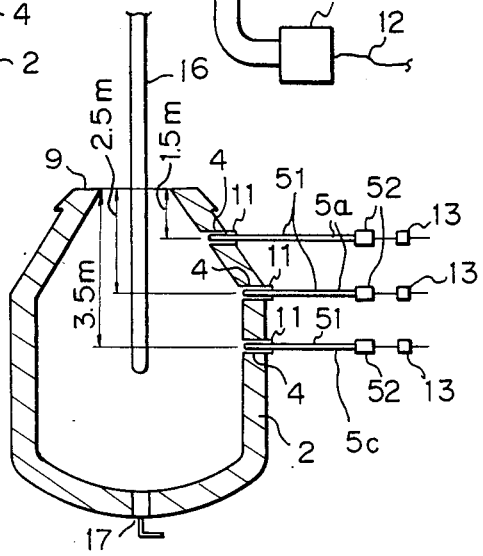
FIG. 8 shows the mounting position of devices for observing the vessel-interior light mounted on a top and bottom blowing converter.

FIG. 8 shows a 170 ton top- and bottom-blowing converter which has a top lance 16 for blowing $O_2$ and a bottom nozzle 17 for blowing $CO_2$.

Throughholes 4 were formed at levels 1.5 m, 2.5 m, and 3.5 m beneath the converter mouth 9. Protective tubes 11 having an inner cylinder 110 (FIG. 7) were inserted into the throughholes 4. An optical conductor 51, having a diameter of 12 mm, was stationarily located in each inner cylinder 110 and was connected to each body of photometers 52. The photometers 52 were ITV cameras equipped with short wavelength-transmitting filters. Signals from the ITV cameras were transmitted into signal processing units 13 including digital memories to store the signals in the digital memories. The digital information was subjected to signal processing for generating an image. The difference in the intensity of light between the gaseous atmosphere and the foaming slag was more distinct than by conventional photometers.

In addition to the observation of the slag-forming conditions as described above, observation using a sublance, hithertofor believed to be the most reliable, was carried out. The temperature of the foaming level of slag was intermittently measured by lowering the sublance equipped with a consumable thermometer at the tip end thereof.

Figure 9:
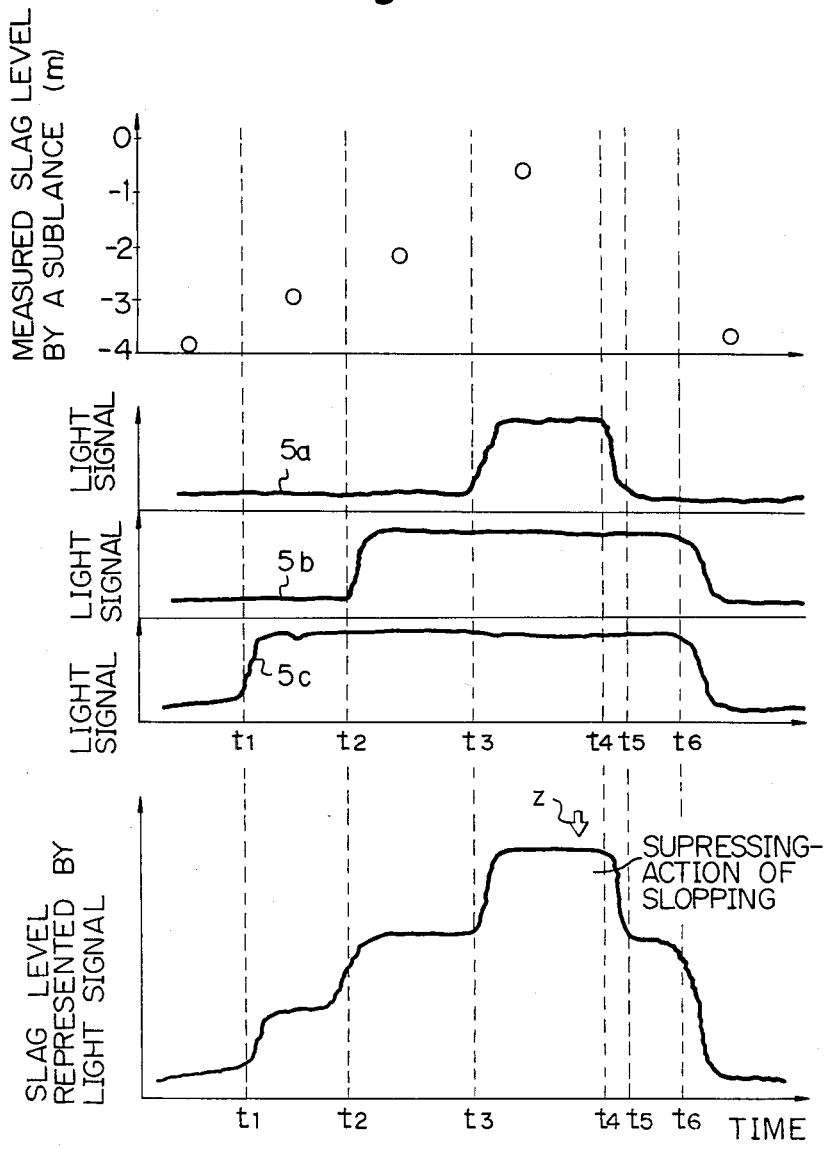
FIG. 9 is a time chart of light signals detected by the devices shown in FIG. 8 and of the slag level detected by using a sublance.

The results are shown in FIG. 9. As is apparent from FIG. 9, there is no appreciable difference between the value measured by the sublance method and the value detected by the method according to the present invention. Thus, the present invention attains measurement of the slag level y at a high accuracy. The present invention attains, furthermore, continuous measurement, which makes it possible to successfully detect or predict the dynamic slag-foaming behavior within the converter.

Table 1 shows the relationship between the total number of heats in which the foaming level of slag y arrived at the respective levels of the photometers and the occurrence of slopping, the relationship being determined by investigations of the assignee.

TABLE 1

| Level of photometers | Total number of heats | Occurrence of slopping | |
|---|---|---|---|
| | | Times | Percentage |
| 1.5 m (5a) | 28 | 15 | 54% |
| 2.5 m (5b) | 35 | 6 | 17% |
| 3.5 m (5c) | 52 | 0 | 0% |

In the present example, the slag-forming criterion was defined as the time when the photometer 5*a* detected the foaming slag, i.e., the slag-foaming criterion indicated abnormal or excessive formation of slag. The intensity of vessel-interior light was continuously measured during blowing by the photometers 5*a*, 5*b*, and 5*c*. When the photometers 5*a*, 5*b*, and 5*c* detected the above-mentioned slag-forming criterion, the warning signal shown by Z in FIG. 19 was generated to warn of abnormal or excessive formation of slag. On the basis of the warning signal, control actions, such as reduction in the $O_2$-flow rate, through the top-blowing lance 16, and charging of unburnt dolomite into the converter 1, were carried out. Due to such control actions, the occurrence of slopping could be reduced to as low as 0.5% or less.

We claim:

1. A method for observing slag foaming conditions in a converter for producing steel comprising:

providing a converter vessel provided with at least one oxygen top blowing lance and holding a molten iron base metal;

providing at least one observation device of vessel interior light for distinguishing light emitted from a gaseous atmosphere within the converter vessel upon facing thereto, and light emitted from foaming slag within the converter vessel upon facing thereto, said observation device disposed in at least one throughhole of a non-immersion part of a side wall of said vessel, with said observation device facing the interior of said vessel;

detecting vessel interior light caused by said foaming slag with said observation device;

determining slag foaming conditions prior to slopping of the slag by analyzing said detected vessel interior light to predict slopping of the slag.

2. A system for observing slag foaming conditions in a converter used for steel refining comprising:

a steel refining converter vessel formed by side and bottom walls;

molten steel disposed in said converter vessel having foaming slag on the surface thereof and a gaseous atmosphere created by said molten steel and foaming slag within said converter vessel above said molten steel, wherein said foaming slag emits light within said converter vessel;

at least one throughhole provided in a non-immersion part of said side wall;

a light detecting receptor means disposed in said throughhole and oriented to face the interior of said vessel for providing a light input signal responsive to said foaming slag emitted light within said converter vessel prior to slopping of said slag;

means connected to said light detector receptor for receiving a light input signal from said receptor and determining the intensity and/or wavelength of said foaming slag emitted light; and means for analyzing said determined intensity and/or wavelength of said foaming slag emitted light and for predicting slopping of the slag.

3. A method according to claim 2 wherein a preselected detected intensity and/or wavelength of the vessel interior light at least at one predetermined height of the vessel is assigned a predetermined slag foaming condition criterion, said slag foaming condition criterion being dephosphorization.

4. A method according to claim 2 wherein a preselected detected intensity and/or wavelength of the vessel interior light at least at one predetermined height of the vessel is assigned a predetermined slag foaming condition criterion, said slag foaming condition criterion being slopping slag.

* * * * *